US007372203B2

(12) United States Patent
Jang et al.

(10) Patent No.: US 7,372,203 B2
(45) Date of Patent: May 13, 2008

(54) PLASMA DISPLAY PANEL HAVING ENHANCED LUMINOUS EFFICIENCY

(75) Inventors: Sang-Hun Jang, Yongin-si (KR); Hidekazu Hatanaka, Seongnam-si (KR); Young-Mo Kim, Suwon-si (KR); Seong-Eui Lee, Seongnam-si (KR); Xiaoqing Zeng, Yongin-si (KR); Seung-Hyun Son, Hwaseong-si (KR); Gi-Young Kim, Chungju-si (KR); Hyoung-Bin Park, Seongnam-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 18 days.

(21) Appl. No.: 10/983,712

(22) Filed: Nov. 9, 2004

(65) Prior Publication Data

US 2005/0110408 A1 May 26, 2005

(30) Foreign Application Priority Data

Nov. 26, 2003 (KR) ..... 10-2003-0084724

(51) Int. Cl.
*H01J 17/49* (2006.01)

(52) U.S. Cl. ..... 313/582; 313/583; 313/584; 313/587; 315/169.1

(58) Field of Classification Search ..... 313/582–587; 315/169.1
See application file for complete search history.

(56) References Cited

U.S. PATENT DOCUMENTS 5,541,618 A 7/1996 Shinoda (Continued)

FOREIGN PATENT DOCUMENTS

EP 1 094 486 4/2001

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Joseph Williams
*Assistant Examiner*—Hana A Sanei
(74) *Attorney, Agent, or Firm*—Robert E. Bushnell, Esq.

(57) ABSTRACT

A plasma display panel includes: a front and a rear substrate which face each other and form a discharge space; address electrodes arranged on an upper surface of the rear substrate; a first dielectric layer formed on the upper surface of the rear substrate and covering the address electrodes; partition walls formed on the upper surface of the rear substrate and partitioning the discharge space to form discharge cells; a fluorescent layer formed on an upper surface of the first dielectric layer and on sidewalls of partition walls, and forming inner surfaces of the discharge cells; first and second sustain electrodes formed on a lower surface of the front substrate in each of the discharge cells in a direction perpendicular to the address electrodes; and a second dielectric layer formed on the lower surface of the front substrate to cover the sustain electrodes, and having protruding portions formed between the sustain electrodes and protruding into discharge cells.

15 Claims, 3 Drawing Sheets

U.S. PATENT DOCUMENTS

| | | | | |
|---|---|---|---|---|
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,742,122 | A * | 4/1998 | Amemiya et al. | 313/582 |
| 5,786,794 | A | 7/1998 | Kishi et al. | |
| 5,952,782 | A | 9/1999 | Nanto | |
| 6,252,353 | B1 * | 6/2001 | Ha et al. | 313/582 |
| RE37,444 | E | 11/2001 | Kanazawa | |
| 6,407,509 | B1 * | 6/2002 | Ikeda et al. | 315/169.4 |
| 6,525,470 | B1 * | 2/2003 | Amemiya | 313/586 |
| 6,531,820 | B1 * | 3/2003 | Lee et al. | 313/586 |
| 6,630,916 | B1 | 10/2003 | Shinoda | |
| 6,707,436 | B2 | 3/2004 | Setoguchi et al. | |
| 6,747,407 | B1 * | 6/2004 | Saito et al. | 313/581 |
| 6,781,309 | B2 * | 8/2004 | Choi et al. | 313/586 |
| 2002/0003515 | A1 * | 1/2002 | Lee et al. | 345/60 |
| 2002/0084751 | A1 * | 7/2002 | Kim | 313/582 |
| 2003/0151363 | A1 * | 8/2003 | Lee et al. | 313/587 |
| 2003/0222580 | A1 * | 12/2003 | Amatsuchi | 313/586 |
| 2004/0041522 | A1 * | 3/2004 | Takada et al. | 313/586 |
| 2004/0212305 | A1 * | 10/2004 | Fujitani et al. | 313/586 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-118521 | 4/2001 |
| JP | 2001-126625 | 5/2001 |
| JP | 2001-135245 | 5/2001 |
| JP | 2001-325888 | 11/2001 |
| JP | 2002-260536 | 9/2002 |
| WO | WO 02/19367 | 3/2002 |
| WO | WO 0219367 A1 * | 3/2002 |

OTHER PUBLICATIONS

Chinese Office action for Chinese patent application No. 2003-84724 issued on Aug. 4, 2006.

*Office Action* from the Japanese Patent Office issued in Applicant's corresponding Japanese Patent Application No. 2004-296703 dated Nov. 20, 2007.

* cited by examiner

PLASMA DISPLAY PANEL HAVING ENHANCED LUMINOUS EFFICIENCY

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on Nov. 26, 2003 and there duly assigned Serial No. 2003-84724.

BACKGROUND OF THE INVENTION

1. Technical Field

The present invention relates to a plasma display panel and, more particularly, to a plasma display panel having enhanced luminous efficiency by improving the structures of sustain electrodes and dielectric layers.

2. Related Art

Plasma display panels (PDPs), which form images using an electric discharge, are widely used due to their excellent performance in such characteristics as brightness and viewing angles. The gas discharge is performed between electrodes by an alternating current (AC) voltage or a direct current (DC) voltage applied to the electrodes, and then visible light is emitted from a fluorescent layer that is excited by ultraviolet light created when the gas discharge is performed.

Plasma display panels are categorized into DC types and AC types according to the discharge type. In DC type plasma display panels, all of the electrodes are exposed to a discharge space, and electric charges move directly between the corresponding electrodes. In AC type plasma display panels, at least one electrode is covered by a dielectric layer and discharge is performed by a wall charge, not by the migration of electric charges between the corresponding electrodes.

Plasma display panels are also categorized into a facing discharge type and a surface discharge type according to the structural arrangement of the electrodes. In the facing discharge type plasma display panel, each pair of sustain electrodes is separately disposed on a front substrate and a rear substrate, and discharge occurs in a direction perpendicular to the substrates. In the surface discharge type plasma display panel, each pair of sustain electrodes is disposed on the same substrate, and discharge occurs in a direction parallel to the surface of the substrate.

The facing discharge type plasma display panels have high luminous efficiency but have a defect in that a fluorescent layer is likely to be deteriorated by plasma. Therefore, the surface discharge type plasma display panels are mainly used.

The plasma display panel includes a rear substrate and a front substrate which face each other. A plurality of address electrodes are arranged in stripes on an upper surface of the rear substrate, and the address electrodes are covered by a first dielectric layer. A plurality of partition walls is formed on an upper surface of the first dielectric layer to prevent electric and optical interference between discharge cells. Inner surfaces of the discharge cells partitioned by the partition walls are coated with fluorescent layers colored in red (R), green (G), and blue (B) to a predetermined thickness, respectively. In general, the interior of the discharge cells is filled with a gaseous mixture composed of neon (Ne) and xenon (Xe).

The front substrate, which is transparent so that visible light can pass through it, is usually made of glass, and is combined with the rear substrate having the partition walls. Sustain electrodes, which are in pairs, are arranged in stripes on a lower surface of the front substrate, and the sustain electrodes cross the address electrodes at right angles. The sustain electrodes are formed of transparent conductive materials such, as indium tin oxide (ITO), which allow visible light to pass through them. Metallic bus electrodes having a narrower width than the sustain electrodes are formed on a lower surface of the sustain electrodes. The sustain electrodes and the bus electrodes are covered by a second dielectric layer, which is transparent, and a protective layer is formed on a lower surface of the second dielectric layer. The protective layer protects the second dielectric layer from being damaged by sputtering of plasma particles, and emits secondary electrons to lower the discharge voltage. In general, the protective layer is formed of magnesium oxide (MgO).

The driving of a plasma display panel having the above configuration is divided into driving an address discharge and driving a sustain discharge. The address discharge occurs between an address electrode and a sustain electrode, thereby forming a wall charge. The sustain discharge occurs as a result of a potential difference between sustain electrodes. When the sustain discharge occurs, a fluorescent layer in contact with the corresponding discharge cell is excited by ultraviolet light emitted from the discharge gas, thereby emitting visible light. The visible light passes through the front substrate forming images that can be recognized by a user.

SUMMARY OF THE INVENTION

The present invention provides a plasma display panel having enhanced luminous efficiency by improving the structures of a plurality of sustain electrodes and a plurality of dielectric layers.

According to an aspect of the present invention, there is provided a plasma display panel including: a front substrate and a rear substrate which face each other and form a discharge space therebetween; a plurality of address electrodes that are arranged in stripes on an upper surface of the rear substrate; a first dielectric layer covering the address electrodes formed on the upper surface of the rear substrate; a plurality of partition walls that are formed on an upper surface of the first dielectric layer, and that partition the discharge space to form a plurality of discharge cells; a fluorescent layer formed on the upper surface of the first dielectric layer and sidewalls of the partition walls forming inner surfaces of the discharge cells; a plurality of first and second sustain electrodes that are formed on a lower surface of the front substrate in each of the discharge cells in a direction perpendicular to the address electrodes, each of the first and second sustain electrodes being composed of a plurality of electrodes; and a second dielectric layer covering the first and second sustain electrodes, the second dielectric layer being formed on the lower surface of the front substrate and having protruding portions formed between the first and the second sustain electrodes and protruding into each of the discharge cells.

A recess may be formed in the first dielectric layer below the protruding portion of the second dielectric layer, and the recess may be formed so as to have a shape corresponding to the protruding portion.

The first sustain electrodes include first and second electrodes separated from each other, and the second sustain electrodes include third and fourth electrodes separated from each other, the first electrode and the fourth electrode being symmetric with respect to a central line between the first and the second sustain electrodes, and the second electrode and the third electrode being symmetric with respect to the same central line.

The second electrode and the third electrode may be adjacent to each other and have the same width. The first electrode and the fourth electrode have the same width, which is larger than that of the second electrode and the third electrode.

The partition walls may be formed in a direction perpendicular to the address electrodes.

A plurality of bus electrodes may be formed on a lower surface of the first sustain electrodes and the second sustain electrodes.

A protective layer may be formed on the lower surface of the second dielectric layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
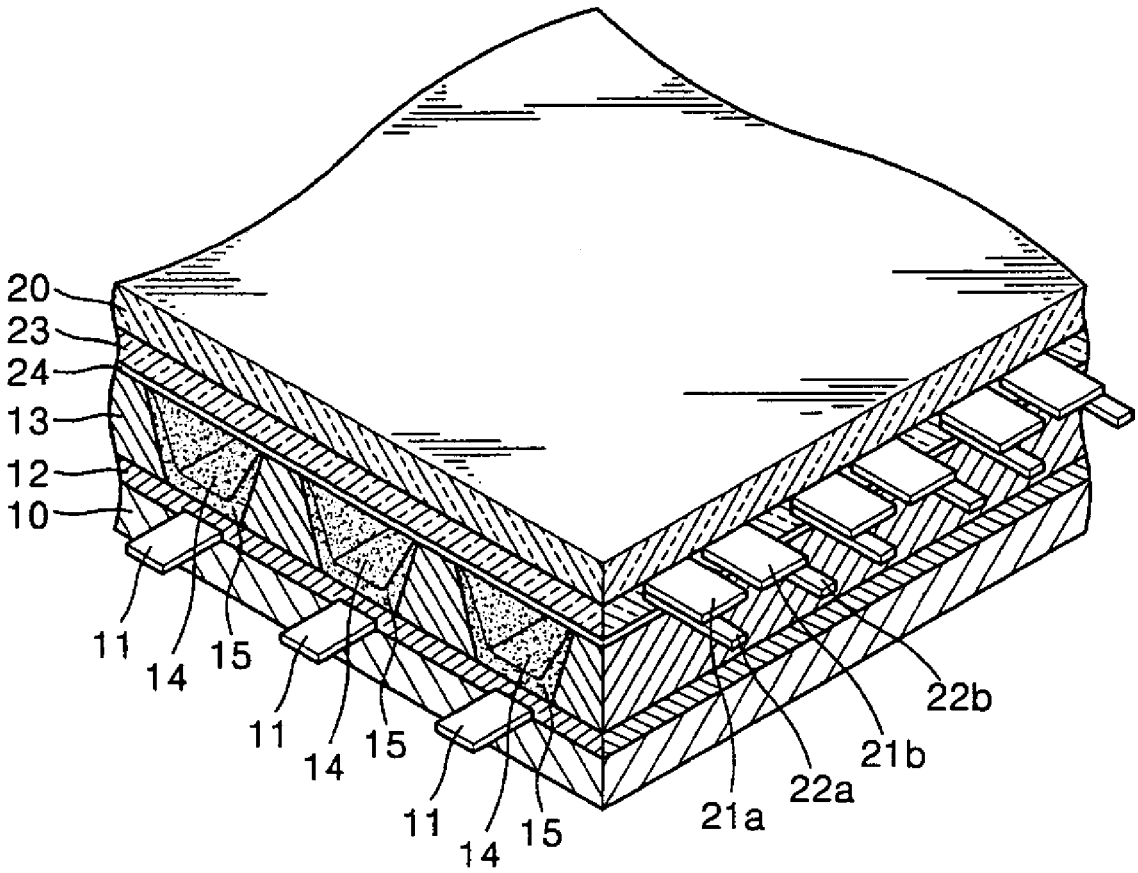
FIG. 1 is an exploded perspective view of a surface discharge type plasma display panel.

Hereinafter, the present invention will be described in detail by explaining preferred embodiments of the invention with reference to the attached drawings. Like reference numerals in the drawings denote like elements.

FIG. 1 is an exploded perspective view of a surface discharge type plasma display panel.

Referring to FIG. 1, the plasma display panel includes a rear substrate 10 and a front substrate 20 which face each other.

A plurality of address electrodes 11 are arranged in stripes on an upper surface of the rear substrate 10, and the address electrodes 11 are covered by a first dielectric layer 12. A plurality of partition walls 13 is formed on an upper surface of the first dielectric layer 12 to prevent electric and optical interference between discharge cells 14. Inner surfaces of the discharge cells 14 partitioned by the partition walls 13 are coated with fluorescent layers 15 colored in red (R), green (G), and blue (B) to a predetermined thickness, respectively. In general, the interior of the discharge cells 14 is filled with a gaseous mixture composed of neon (Ne) and xenon (Xe).

The front substrate 20, which is transparent so that visible light can pass through it, is usually made of glass, and is combined with the rear substrate 10 having the partition walls 13. Sustain electrodes 21*a* and 21*b*, which are in pairs, are arranged in stripes on a lower surface of the front substrate 20, and the sustain electrodes 21*a* and 21*b* cross the address electrodes 11 at right angles. The sustain electrodes 21*a* and 21*b* are formed of transparent conductive materials, such as indium tin oxide (ITO), which allow visible light to pass through them. Metallic bus electrodes 22*a* and 22*b* having a narrower width than the sustain electrodes 21*a* and 21*b* are formed on a lower surface of the sustain electrodes 21*a* and 21*b*. The sustain electrodes 21*a* and 21*b* and the bus electrodes 22*a* and 22*b* are covered by a second dielectric layer 23, which is transparent, and a protective layer 24 is formed on a lower surface of the second dielectric layer 23. The protective layer 24 protects the second dielectric layer 23 from being damaged by sputtering of plasma particles, and emits secondary electrons to lower the discharge voltage. In general, the protective layer 24 is formed of magnesium oxide (MgO).

The driving of a plasma display panel having the above configuration is divided into driving an address discharge and driving a sustain discharge. The address discharge occurs between an address electrode 11 and a sustain electrode 21*a*, thereby forming a wall charge. The sustain discharge occurs as a result of a potential difference between sustain electrodes 21*a* and 21*b*. When the sustain discharge occurs, a fluorescent layer 15 in contact with the corresponding discharge cell 14 is excited by ultraviolet light emitted from the discharge gas, thereby emitting visible light. The visible light passes through the front substrate 20 forming images that can be recognized by a user.

Figure 2:
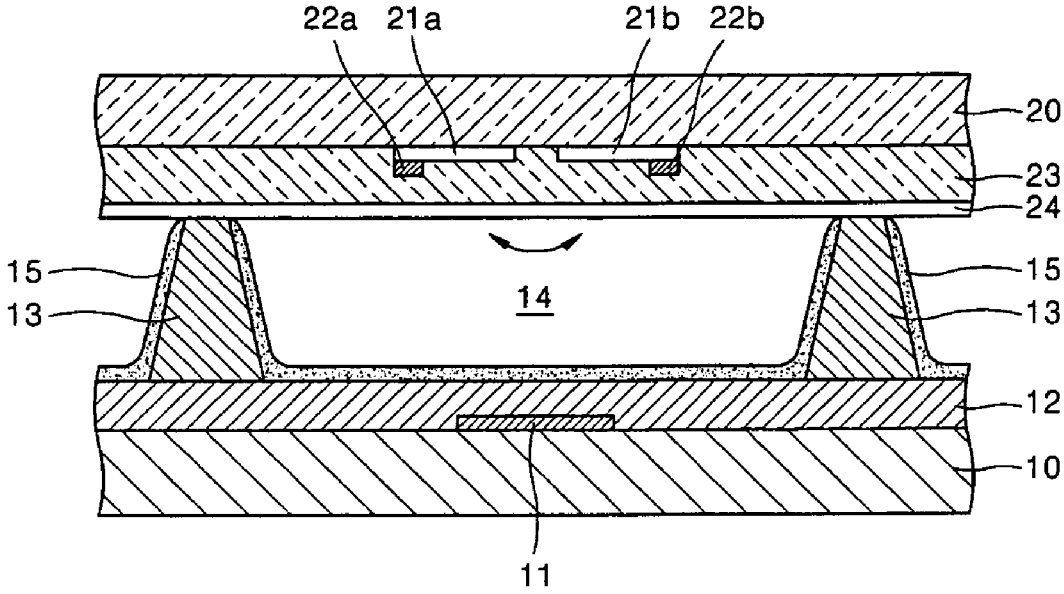
FIG. 2 is a cross-sectional view of the plasma display panel in which the interval between a plurality of sustain electrodes is narrow.
Figure 3:
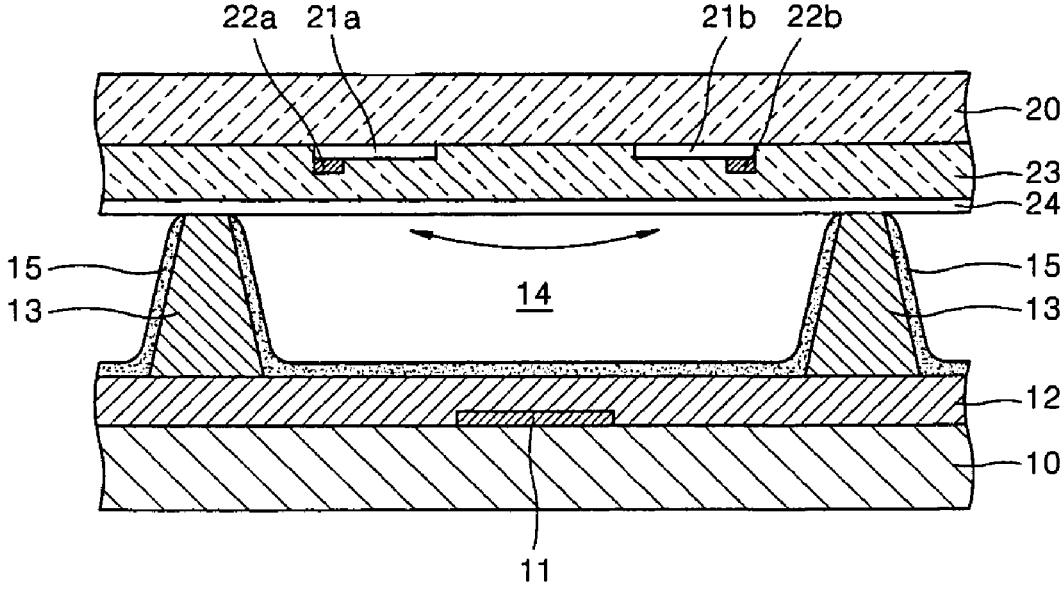
FIG. 3 is a cross-sectional view of the plasma display panel in which the interval between a plurality of sustain electrodes is wide.

FIGS. 2 and 3 are cross-sectional views of plasma display panels having a configuration similar to that described above, in which intervals between the sustain electrodes 21*a* and 21*b* are narrow and wide, respectively. In FIGS. 2 and 3, for a better understanding of the inner structure of the plasma display panel, only a front substrate rotated by 90 degrees is shown.

Referring to FIG. 2, if the distance between the sustain electrodes 21*a* and 21*b* is narrow, the sustain discharge voltage may be decreased but the luminous efficiency is degraded. Referring to FIG. 3, if the distance between sustain electrodes 21*a* and 21*b* is wide, the luminous efficiency may be improved, but the sustain discharge voltage is increased.

Figure 4:
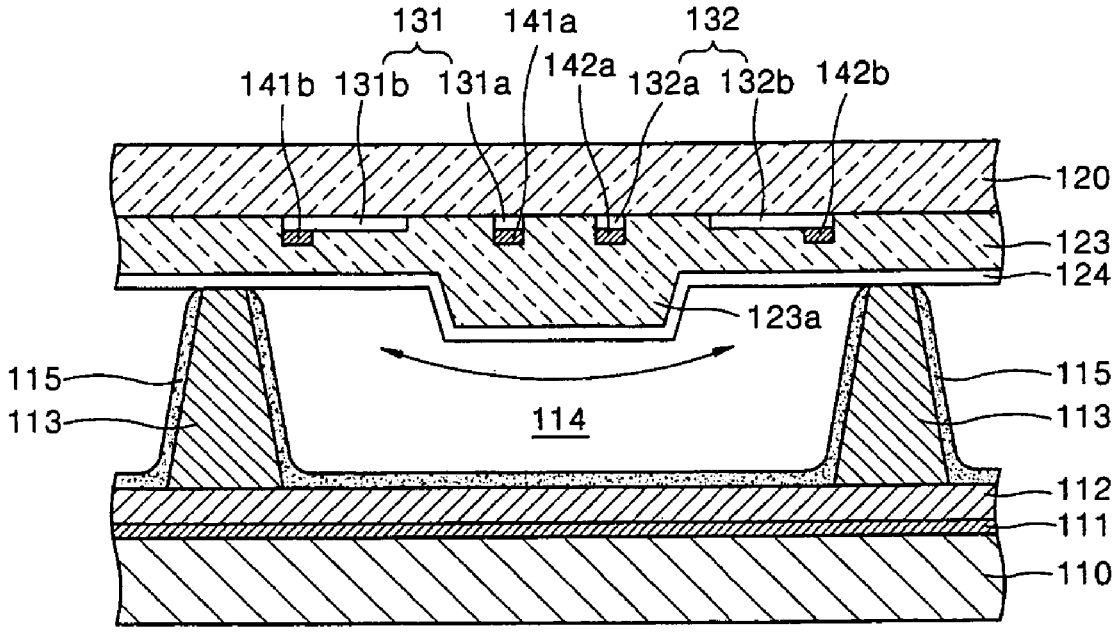
FIG. 4 is a vertical sectional view of a plasma display panel according to an embodiment of the present invention.

FIG. 4 is a vertical sectional view of an inner structure of a plasma display panel according to an embodiment of the present invention.

Referring to FIG. 4, a plasma display panel according to an embodiment of the present invention includes a rear substrate 110 and a front substrate 120 which are separated from and face each other. A space formed between the rear substrate 110 and the front substrate 120 is the discharge space wherein the plasma discharge occurs.

A plurality of address electrodes 111 for address discharge are formed in stripes on an upper surface of the rear substrate 10, which is formed of glass. A first dielectric layer 112 is formed on the upper surface of the rear substrate 110 to cover the address electrodes 111. The first dielectric layer 112 can be formed by being coated with a white dielectric material to a predetermined thickness.

A plurality of partition walls 113 is formed on an upper surface of the first dielectric layer 112 at a predetermined interval. The partition walls 113 are formed in a direction perpendicular to the address electrodes 111. The discharge space between the rear substrate 110 and the front substrate 120 is partitioned to thereby form a plurality of discharge cells 114. The partition walls 113 prevent electric and optical crosstalk between adjacent discharge cells so that color purity is improved. The upper surface of the first dielectric layer 112 and sidewalls of the partition walls 113, which form inner surfaces of the discharge cells 114, are coated with fluorescent layers 115 colored in red (R), green (G) and blue (B), respectively, to a predetermined thickness. The fluorescent layer 115 is exited by ultraviolet light created by the plasma discharge, thereby emitting visible light. The interior of the discharge cells 114 is filled with a commonly used gaseous mixture composed of neon (Ne), and xenon (Xe).

The front substrate 120 is a transparent substrate so that visible light passes through it. The front substrate 120 is usually made of glass. First and second sustain electrodes 131 and 132 are formed in pairs on a lower surface of the front substrate 120 in each of the discharge cells 114 in which a sustain discharge is performed. The first sustain electrodes 131 include first electrode 131*b* and second electrode 131*a* that are separated from each other and perpendicular to the address electrode 111. The second sustain electrodes 132 include third electrode 132*a* and fourth electrode 132*b* that are separated from each other and are perpendicular to the address electrode 111. The first electrode 131*b* and the fourth electrode 132*b* are symmetric with respect to a central line between the first sustain electrodes 131 and the second sustain electrodes 132. The second electrode 131*a* and the third electrode 132*a* are also symmetric with respect to the central line. The second electrode 131*a* and the third electrode 132*a* are adjacent to each other and have the same width. The first electrode 131*b* and the fourth electrode 132*b* have the same width. The widths of the second electrode 131*a* and the third electrode 132*a* are narrower than those of the first electrode 131 band the fourth electrode 132*b*. The first electrode 131*b* and the second electrode 131*a*, and the third electrode 132*a* and the fourth electrode 132*b* are formed of a transparent material, such as indium tin oxide (ITO) so that visible light can pass through them. Bus electrodes 141*b*, 141*a*, 142*a* and 142*b*, made of metallic material, are formed on a lower surface of the first, second, third and fourth electrodes 131*b*, 131*a*, 132*a* and 132*b*, respectively, and thereby the line resistance of the first, second, third and fourth electrodes 131*b*, 131*a*, 132*a* and 132*b*, respectively, can be reduced.

A predetermined amount of voltage is applied to the first and the second sustain electrodes 131 and 132, respectively, in which the first sustain electrodes 131 include the first and second electrodes 131*b* and 131*a*, respectively, and the second sustain electrodes 132 include the third and fourth electrodes 132*a* and 132*b*, respectively. As a result of the application of the predetermined amount of voltage, discharge voltage can be decreased due to a start discharge performed between the second and third electrodes 131*a* and 132*a*, respectively, that are adjacent to each other. Furthermore, luminous efficiency can be improved due to a main discharge performed between the first and the fourth electrodes 131*b* and 132*b*, respectively.

A second dielectric layer 123 covering the first and the second sustain electrodes 131 and 132, respectively, and the bus electrodes 141*b*, 141*a*, 142*a* and 142*b* is formed on the lower surface of the front substrate 120. The lower surface of the front substrate 120 is covered with a transparent dielectric material so as to form the second dielectric layer 123. A protruding portion 123*a* of the second dielectric layer 123 is formed between the first and second sustain electrodes 131 and 132, respectively, so as to protrude into the discharge cell 114. In the second electric layer 123, both side regions of the protruding portion 123*a* are thinner than those of a conventional dielectric layer. Therefore, the sustain electrodes 131 and 132 positioned in both side regions of the protruding portion 123*a* are provided with a higher voltage than conventional sustain electrodes. As a result, electrons remaining on the protruding portion 123*a* move smoothly to both side regions of the second dielectric layer 123, and a discharge path is lengthened, thereby increasing the high luminous efficiency.

A protective layer 124 is formed on a lower surface of the second dielectric layer 123. The protective layer 124 not only prevents the second dielectric layer 123 and the first and second sustain electrodes 131 and 132, respectively, from being damaged by sputtering of plasma particles, but also emits second electrons to lower the discharge voltage. A lower surface of the second dielectric layer 123 is coated with magnesium oxide (MgO) to a predetermined thickness.

In a plasma display panel having the configuration described above, the interior of the discharge cell 114 is filled a gaseous mixture of Ne and Xe at a pressure of 500 torr, in which Xe is in a concentration of 5%, and a voltage of 180 V is applied alternatively to each of the sustain electrodes 131 and 132. As such, the efficiency of the plasma display panel is improved by 28.01%, compared to that of a conventional plasma display panel.

Figure 5:
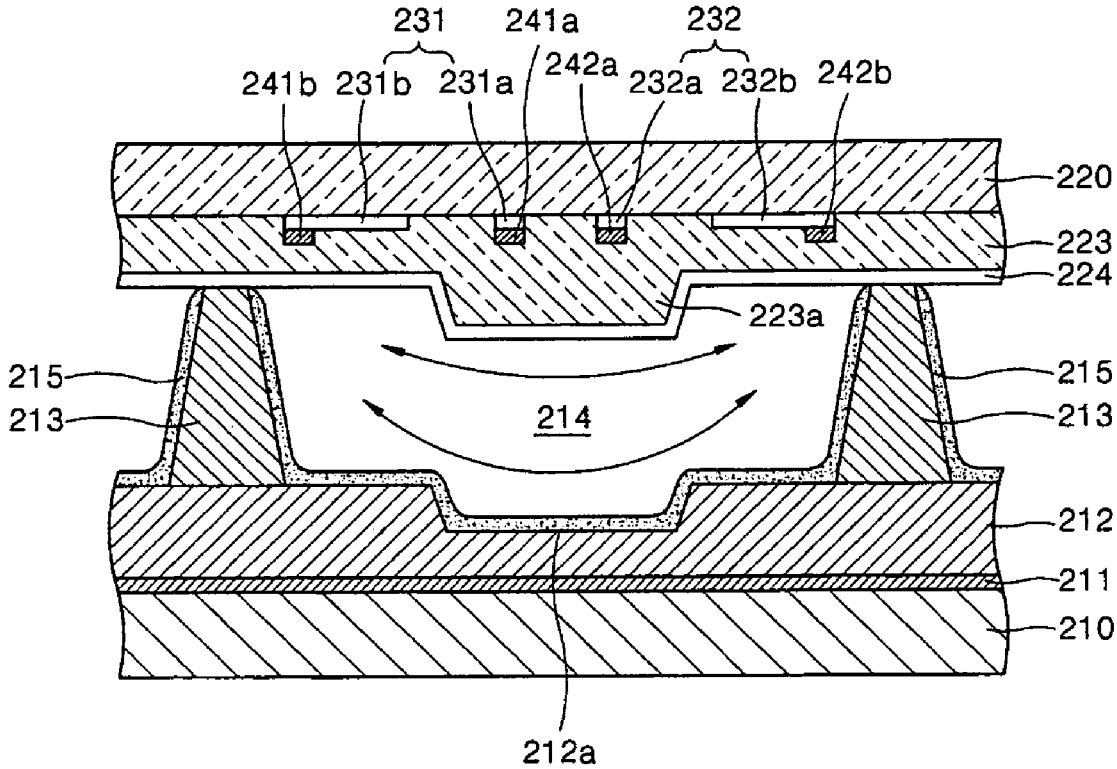
FIG. 5 is a vertical sectional view of a plasma display panel according to another embodiment of the present invention.

FIG. 5 is a vertical sectional view of an inner structure of a plasma display panel according to other embodiment of the present invention.

Referring to FIG. 5, the plasma display panel includes a rear substrate 210 and a front substrate 220 that are separated from and face each other.

A plurality of address electrodes 211 is arranged in stripes on an upper surface of the rear substrate 210. A first dielectric layer 212 covering the address electrodes 211 is formed on the upper surface of the rear substrate 210. A recess 212*a*, having a form corresponding to a protruding portion 223*a* of a second dielectric layer 223, is formed in the first dielectric layer 212.

A plurality of partition walls 213 is formed on an upper surface of the first dielectric layer 212 at a predetermined interval. The partition walls 213 are formed in a direction perpendicular to the address electrodes 211. A discharge space between the rear substrate 210 and the front substrate 220 is partitioned by a plurality of partition walls 213 so as to form discharge cells 213. The upper surface of the first dielectric layer 212 and sidewalls of a plurality of partition walls 213 forming inner surfaces of the discharge cells 214 are coated with fluorescent layers 215 colored in red (R), green (G), and blue (B), respectively, to a predetermined thickness. The interior of the discharge cells 214 is filled with a gaseous mixture composed of neon (Ne), and xenon (Xe).

First and second sustain electrodes 231 and 232, respectively, for sustain discharge are formed in pairs on a lower surface of the front substrate 220 and inside the discharge cells 214. Each of the discharge cells 214 has the first and the second sustain electrodes 231 and 232, respectively. The first sustain electrodes 231 include first electrode 231*b* and second electrode 231*a* that are separated from each other and are perpendicular to the address electrodes 211. The second sustain electrodes 232 include third electrode 232*a* and fourth electrode 232*b* that are separated from each other and are perpendicular to the address electrodes 211. Details about the first, second, third and fourth electrodes 231*b*, 231*a*, 232*a* and 232*b*, respectively, will not be presented because they are described in the forgoing embodiment of the present invention. Bus electrodes 241*b*, 241*a*, 242*a* and 242*b*, each of which is formed of a metallic material, are formed on a lower surface of the first, second, third and fourth electrodes 231*b*, 231*a*, 232*a* and 232*b*, respectively.

A second dielectric layer 223 covering the first and second sustain electrodes 231 and 232, respectively, and covering bus electrodes 241*b*, 241*a*, 242*a* and 242*b*, is formed on the lower surface of the front substrate 220. A protruding portion 223*a* having a predetermined form is formed in the second dielectric layer 223 between the first and second sustain electrodes 231 and 232, respectively, and protrudes into the discharge cell 214. Both side regions of the protruding portion 223*a* of the second dielectric layer 223 are thinner than those of a conventional dielectric layer. Therefore, the sustain electrodes 231 and 232 positioned in both side regions of the protruding portion 223*a* are provided with a higher voltage than conventional sustain electrodes, and thereby electrons remaining on the protruding portion 223*a* move smoothly toward both side regions of the protruding portion 223*a* of the second dielectric layer 223, and the discharge path is lengthened.

Meanwhile, as described above, the recess 212*a* corresponding to the protruding portion 223*a* is formed in the first dielectric layer 212, both side regions of the recess 212*a* being thicker than those of a conventional dielectric layer. As a result, in both side regions of the recess 212*a*, the distance between the first dielectric layer 212 and sustain electrodes 231 and 232 is smaller, and thereby the address discharge is performed at a high speed. In addition, the discharge path remains uniform because the recess 212*a* corresponding to the protruding portion 223*a* is formed in the first dielectric layer 212.

A protective layer 224 is formed on the lower surface of the second dielectric layer 223. The lower surface of the dielectric layer 223 is coated with magnesium oxide (MgO) to a predetermined thickness.

In the plasma display panel having the above configuration, the interior of the discharge cell 214 is filled with a gaseous mixture of Ne and Xe at a pressure of 500 torr, in which Xe is in a concentration of 5%, and a voltage of 180 V is applied alternatively to each of the sustain electrodes 231 and 232. As such, the efficiency of the plasma display panel is improved by 28.45%, compared to that of a conventional plasma display panel.

As described above, the plasma display panel according to the present invention has the following effects.

First, the discharge path can be lengthened when a protruding portion is formed in the second dielectric layer formed on the lower surface of the front substrate. Thus, the luminous efficiency is improved.

Second, when a recess is formed in the first dielectric portion, a uniform discharge path can be obtained and address discharge can be performed at a high speed.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a front substrate and a rear substrate which face each other and which form a discharge space therebetween;

a plurality of address electrodes arranged in stripes on an upper surface of the rear substrate;

a first dielectric layer formed on the upper surface of the rear substrate to cover the address electrodes;

a plurality of partition walls that are formed on an upper surface of the first dielectric layer and that partition the discharge space to form a plurality of discharge cells;

a fluorescent layer formed on the upper surface of the first dielectric layer and on sidewalls of the partition walls forming inner surfaces of the discharge cells;

first sustain electrodes and second sustain electrodes formed on a lower surface of the front substrate in each of the discharge cells in a direction perpendicular to the address electrodes, each of the first sustain electrodes and the second sustain electrodes comprising a plurality of electrodes; and a second dielectric layer covering the first sustain electrodes and the second sustain electrodes and formed on the lower surface of the front substrate, the second dielectric layer having a lower surface comprising horizontal surface portions which are parallel to the lower surface of the front substrate, each pair of horizontal surface portions being separated by a protruding portion, each protruding portion being centered on a line which is centered between the first sustain electrodes and the second sustain electrodes, each protruding portion extending away from said pair of horizontal surface portions so as to protrude into a respective one of the discharge cells;

wherein a recess is formed in the first dielectric layer below each of the protruding portions of the second dielectric layer; and wherein the recess is formed to have a shape corresponding to said each of the protruding portions.

2. The plasma display panel of claim 1, wherein the first sustain electrodes include first and second electrodes separated from each other, and the second sustain electrodes include third and fourth electrodes separated from each other, the first and the fourth electrodes being symmetric with respect to a central line between the first sustain electrodes and the second sustain electrodes, and the second and the third electrodes being symmetric with respect to the central line.

3. The plasma display panel of claim 2, wherein the second electrode and the third electrode are adjacent to each other.

4. The plasma display panel of claim 3, wherein the second electrode and the third electrode have the same width, and the first electrode and the fourth electrode have the same width.

5. The plasma display panel of claim 4, wherein the width of the second electrode and the third electrode is smaller than the width of the first electrode and the fourth electrode.

6. The plasma display panel of claim 1, wherein the partition walls are formed in a direction perpendicular to the address electrodes.

7. The plasma display panel of claim 1, further comprising a plurality of bus electrodes formed on a lower surface of the first sustain electrodes and the second sustain electrodes.

8. The plasma display panel of claim 1, further comprising a protective layer formed on a lower surface of the second dielectric layer.

9. A plasma display panel, comprising:

a front substrate and a rear substrate which face each other and which form a discharge space therebetween;

a plurality of address electrodes arranged in stripes on an upper surface of the rear substrate;

a first dielectric layer formed on the upper surface of the rear substrate to cover the address electrodes;

a plurality of partition walls that are formed on an upper surface of the first dielectric layer and that partition the discharge space to form a plurality of discharge cells;

a fluorescent layer formed on the upper surface of the first dielectric layer and on sidewalls of the partition walls forming inner surfaces of the discharge cells;

first sustain electrodes and second sustain electrodes formed on a lower surface of the front substrate in each of the discharge cells in a direction perpendicular to the address electrodes; and a second dielectric layer covering the first sustain electrodes and the second sustain electrodes and formed on the lower surface of the front substrate;

wherein the first sustain electrodes include first and second electrodes separated from each other, and the second sustain electrodes include third and fourth electrodes separated from each other;

wherein the second dielectric layer includes a lower surface comprising horizontal surface portions which are parallel to the lower surface of the front substrate, each pair of horizontal surface portions being separated by a protruding portion, each protruding portion being centered on a line which is centered between the first sustain electrodes and the second sustain electrodes, each protruding portion extending away from said pair of horizontal surface portions so as to protrude into the discharge cells, and a recess is formed in the first dielectric layer below each of the protruding portions of the second dielectric layer; and wherein the recess is formed to have a shape corresponding to said each of the protruding portions.

10. The plasma display panel of claim 9, wherein the first and the fourth electrodes are symmetric with respect to a central line between the first sustain electrodes and the second sustain electrodes, and the second and the third electrodes are symmetric with respect to the central line.

11. The plasma display panel of claim 9, wherein the second electrode and the third electrode are adjacent to each other.

12. The plasma display panel of claim 9, wherein the second electrode and the third electrode have the same width, and the first electrode and the fourth electrode have the same width.

13. The plasma display panel of claim 12, wherein the width of the second electrode and the third electrode is smaller than the width of the first electrode and the fourth electrode.

14. The plasma display panel of claim 9, wherein the partition walls are formed in a direction perpendicular to the address electrodes.

15. The plasma display panel of claim 9, further comprising a protective layer formed on a lower surface of the second dielectric layer.

* * * * *